US008556466B2

(12) United States Patent
Shin et al.

(10) Patent No.: US 8,556,466 B2
(45) Date of Patent: Oct. 15, 2013

(54) LIGHTING APPARATUS USING LIGHT-EMITTING DIODE

(75) Inventors: Sang Hyun Shin, Gyeonngi-do (KR); Seung Hyun Cho, Gyeonngi-do (KR); Dae Hyun Sung, Gyeonggi-do (KR)

(73) Assignee: Wooree Lighting Co., Ltd., Gyeonggi-Do (KR)

( * ) Notice: Subject to any disclaimer, the term of this patent is extended or adjusted under 35 U.S.C. 154(b) by 329 days.

(21) Appl. No.: 12/682,015

(22) PCT Filed: Feb. 26, 2010

(86) PCT No.: PCT/KR2010/001239
§ 371 (c)(1),
(2), (4) Date: Jul. 12, 2011

(87) PCT Pub. No.: WO2011/096615
PCT Pub. Date: Aug. 11, 2011

(65) Prior Publication Data

US 2011/0291569 A1 Dec. 1, 2011

(30) Foreign Application Priority Data

Feb. 5, 2010 (KR) ..... 10-2010-0011220

(51) Int. Cl.
*F21V 29/00* (2006.01)

(52) U.S. Cl.
USPC ..... 362/294; 362/613; 362/631; 362/249.02; 361/713

(58) Field of Classification Search
USPC ..... 362/235, 249.02, 294, 373, 561, 612, 362/613, 630, 631; 361/701–703, 713; 315/113
See application file for complete search history.

(56) References Cited

U.S. PATENT DOCUMENTS

| | | | | |
|---|---|---|---|---|
| 7,488,104 | B2 * | 2/2009 | Hamada et al. | 362/616 |
| 7,746,638 | B2 * | 6/2010 | Takawa et al. | 361/690 |
| 2013/0027928 | A1 * | 1/2013 | Kang et al. | 362/235 |
| 2013/0039056 | A1 * | 2/2013 | Cho et al. | 362/235 |
| 2013/0058098 | A1 * | 3/2013 | Kim et al. | 362/294 |

FOREIGN PATENT DOCUMENTS

KR 1020080093527 10/2008

* cited by examiner

*Primary Examiner* — Haiss Philogene
(74) *Attorney, Agent, or Firm* — Samuel Digirolamo; Husch Blackwell LLP

(57) ABSTRACT

The present disclosure provides a lighting apparatus using a light-emitting diode (LED), which includes: LEDs; a power transfer substrate with the LEDs thereon; a radiating member radiating heat generated in the LEDs; a driver electrically connected to the power transfer substrate and integrally coupled to the power transfer substrate and the radiating member; and a heat insulation layer reducing the amount of heat transferred from the radiating member to the driver. In addition, the present disclosure provides a lighting apparatus using an LED, which further includes a cradle fixed to a given object and detachably fixing a lighting body in which a power transfer substrate with LEDs thereon, a radiating member and a driver have been integrally coupled.

12 Claims, 8 Drawing Sheets

LIGHTING APPARATUS USING LIGHT-EMITTING DIODE

CROSS REFERENCE TO RELATED APPLICATIONS

This application is a U.S. National Phase Application of International Application PCT Application No. PCT/KR2010/001239 filed on Feb. 26, 2010, which claims the benefit of priority from Korean Patent Application No. 10-2010-0011220 filed on Feb. 5, 2010. The disclosures of International Application PCT Application No. PCT/KR2010/001239 and Korean Patent Application No. 10-2010-0011220 are incorporated herein by reference.

TECHNICAL FIELD

The present invention relates generally to a lighting apparatus using a light-emitting diode (LED), and, more particularly, to a lighting apparatus using an LED which can improve compatibility with conventional lighting apparatuses because it is operable by the connection to a commercial power source, prevent components from being damaged by heat generated in the LED, and have few restrictions in the installation environment.

BACKGROUND ART

This section provides background information related to the present disclosure which is not necessarily prior art.

Recently, research has been actively made on a lighting apparatus using an LED as a light source, instead of conventional various lighting apparatuses using an incandescent lamp, a fluorescent lamp, a halogen lamp, and so on as a light source. Some of the lighting apparatuses using the LED have been released as products.

The reasons for this are that the LED has advantages such as a small amount of heat generation, low power consumption, a long life, shock endurance, etc., as compared with the conventional light sources, and that the LED which does not use mercury or discharge gas during the manufacturing process unlike the fluorescent lamp does not cause the environmental pollution.

However, for the purpose of public distribution of the lighting apparatus using the LED as the light source, it is required to solve problems associated with radiation of heat generated by high-luminance light emission and compatibility with the conventional lighting apparatuses.

FIG. 1 is a view of a lighting apparatus using an LED, which has been described in Korean Patent Publication No. 2008-0093527. A lighting apparatus 1 includes a circuit board 30 on which LEDs 31 are mounted, a hollow main body 10 to which the circuit board 30 is fixed and on which radiating fins 11 are formed, and a driver 20 received in the main body 10, converting AC power into DC power, and supplying the DC power to the LEDs 31. The lighting apparatus 1 can be fixed to the wall, ceiling, or the like by brackets 60 provided at both ends of the main body 10.

In terms of heat radiation, heat generated from the LEDs 31 is radiated through the radiating fins 11 formed on the main body 10. However, since the driver 20 is inserted into and positioned in the main body 10, the radiated heat is transferred to the driver 20, which may degrade the performance of the driver 20.

In addition, since the driver 20 is inserted into and positioned in the main body 11, if the driver 20 has a failure, it is not easy to separate and replace, which may lead to the replacement of the entire lighting apparatus 1.

Meanwhile, in terms of compatibility, as the lighting apparatus 1 is fixed using the brackets 60, it has no restriction in the installation position. However, the brackets 60 are integrally formed with the lighting apparatus 1, and thus replaced upon the replacement of the lighting apparatus 1, which causes the waste of resources.

SUMMARY

Technical Problem

The problems to be solved by the present disclosure will be described in the latter part of the best mode for carrying out the invention.

Technical Solution

This section provides a general summary of the disclosure and is not a comprehensive disclosure of its full scope or all of its features.

According to one aspect of the present disclosure, there is provided a lighting apparatus using a light-emitting diode (LED), which includes: LEDs; a power transfer substrate with the LEDs thereon; a radiating member radiating heat generated in the LEDs; a driver electrically connected to the power transfer substrate and integrally coupled to the power transfer substrate and the radiating member; and a heat insulation layer reducing the amount of heat transferred from the radiating member to the driver.

Here, the lighting apparatus using the LED may further include a cradle fixed to a given object and detachably fixing a lighting body in which the power transfer substrate with the LEDs thereon, the radiating member and the driver have been integrally coupled.

Advantageous Effects

The advantageous effects of the present disclosure will be described in the latter part of the best mode for carrying out the invention.

DETAILED DESCRIPTION OF THE INVENTION

The present disclosure will now be described in detail with reference to the accompanying drawings.

Figure 1:
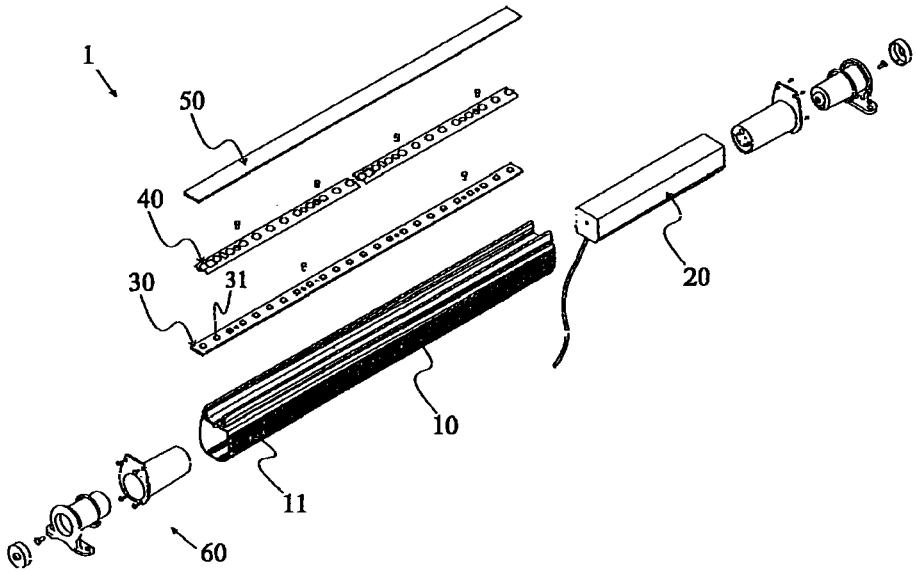
FIG. 1 Prior Art
FIG. 1 is a view of a lighting apparatus using an LED, which has been described in Korean Patent Publication No. 2008-0093527.
Figure 2:
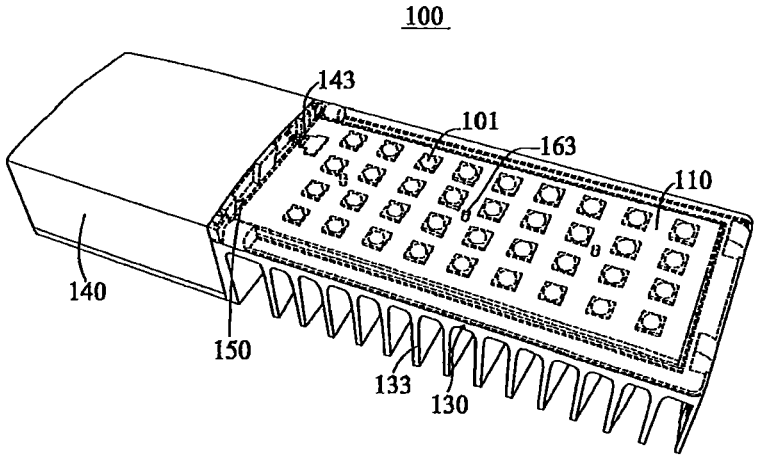
FIG. 2 is a view of a lighting apparatus using an LED according to an embodiment of the present disclosure.
Figure 3:
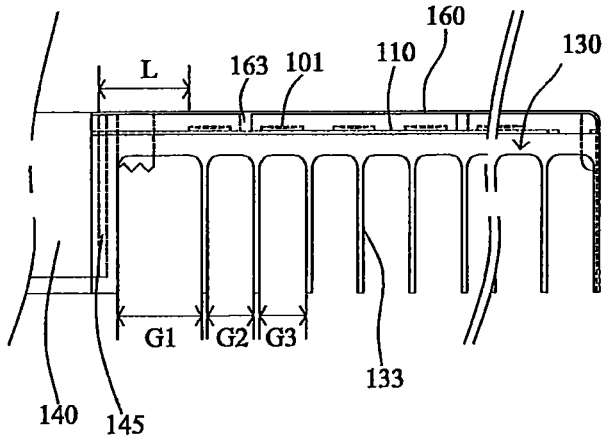
FIG. 3 is a side view of the lighting apparatus using the LED of FIG. 2.
Figure 4:
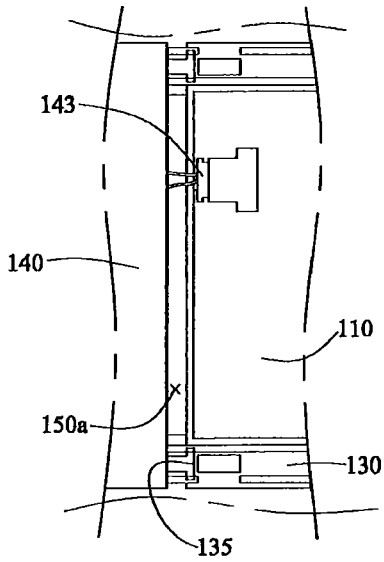
FIG. 4 is a view of a coupling state of a radiating member and a driver of FIG. 2.

FIG. 2 is a view of a lighting apparatus using a light-emitting diode (LED) according to an embodiment of the present disclosure, FIG. 3 is a side view of the lighting apparatus using the LED of FIG. 2, and FIG. 4 is a view of a coupling state of a radiating member and a driver of FIG. 2. A lighting apparatus 100 using an LED according to the present embodiment includes LEDs 101, a power transfer substrate 110, a radiating member 130, a driver 140 integrally coupled to the radiating member 130, and a heat insulation layer 150.

The power transfer substrate 110 is a printed circuit board (PCB).

The LEDs 101 are installed on one surface (hereinafter, referred to as 'LED-installed surface') of the power transfer substrate 110 and receive power, signals, and so on.

The number and arrangement of the LEDs 101 installed on the LED-installed surface can be optimized by a designer to be suitable for the characteristics of a place to be lighted.

In detail, it is preferable that the LEDs 101 positioned most adjacent to the driver 140 among the plurality of LEDs 101 installed on, the LED-installed surface should be spaced apart from the driver 140 by an interval L.

The interval L serves to interrupt heat transfer between the LEDs 101 operating as a heat source and the driver 140 which may be damaged by heat, thus protecting the driver 140.

The radiating member 130 is provided on a rear surface (hereinafter, referred to as 'radiating member-installed surface') of the LED-installed surface.

Preferably, the radiating member 130 and the power transfer substrate 110 are coupled to each other in such a manner that the entire radiating member-installed surface can be brought into contact with the radiating member 130.

As such, heat generated in the LEDs 101 and the power transfer substrate 110 can be effectively transferred to the radiating member 130.

Preferably, the radiating member 130 includes a plurality of radiating fins 133 to effectively radiate heat.

The shape, arrangement and interval of the plurality of radiating fins 133 can be optimized in consideration of a heat load generated in the LEDs 101 and the power transfer substrate 110 and heat conductivity of the radiating member 130 including the plurality of radiating fins 133.

In detail, it is preferable that the plurality of radiating fins 133 should be arranged so that an interval G1 between the radiating fins 133 most adjacent to the driver 140 can be the largest among intervals G1, G2, G3, etc. between the radiating fins 133 adjacent to each other.

That is, the plurality of radiating fins 133 finally radiating heat are disposed relatively far from the driver 140, thereby effectively preventing the driver 140 from being damaged by heat.

Here, the intervals G2 and G3 may be same or different.

The driver 140 electrically connects an external power source (not shown) to the LEDs 101 and transfers electrical signals to the LEDs 101.

The driver 140 may be configured to convert AC power into DC power or to supply power and operation signals to the LEDs 101 via the power transfer substrate 110.

The driver 140 is electrically connected to the external power source (not shown) and includes an output terminal 143 connected to the power transfer substrate 110.

The heat insulation layer 150 is provided as a gap 150*a* defined between coupling surfaces of the driver 140 and the radiating member 130.

The driver 140 and the radiating member 130 are coupled to each other with their side surfaces opposite to each other.

Accordingly, the coupling surfaces of the driver 140 and the radiating member 130 indicate the side surfaces thereof.

The side surface of the radiating member 130 indicates the surface defined when the surface of the radiating member 130 to which the power transfer substrate 110 is coupled is referred to as the top surface of the radiating member 130.

The gap 150*a*, which means an empty space, is filled with the air of low heat conductivity.

Therefore, the amount of heat transferred to the driver 140 in the heat radiated from the radiating member 130 is minimized, which prevents the driver 140 from being damaged by heat.

In detail, the gap 150*a* may be defined by a groove 130*a* provided in at least one of the coupling surfaces of the driver 140 and the radiating member 130.

In addition, the gap 150*a* may be provided as a number of air voids defined between the coupling surfaces of the driver 140 and the radiating member 130.

The air voids can be defined when at least one of the coupling surfaces of the driver 140 and the radiating member 130 is uneven.

Meanwhile, preferably, the lighting apparatus 100 using the LED according to the present embodiment may further include a light-transmitting cover 160 covering the LEDs 101 and allowing light to transmit therethrough.

Figure 5:
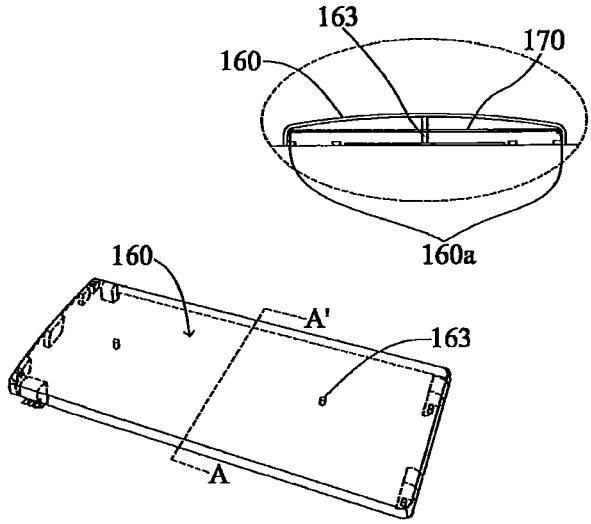
FIG. 5 is a view of a light-transmitting cover of FIG. 2 and its section.

FIG. 5 is a view of the light-transmitting cover of FIG. 2 and its section. The light-transmitting cover 160 has a sufficient size to cover the LEDs 101 provided on the power transfer substrate 110.

Preferably, the light-transmitting cover 160 has a scattering surface for scattering light so as to increase the distribution angle of light emitted therethrough. The reason for this is that the light emitted from the LEDs 101 needs to be scattered because of its strong linearity.

Aside from this, a light distribution control sheet 170 may be detachably provided on the light-transmitting cover 160 and control the light distribution characteristics.

Controlling the light distribution characteristics means increasing or decreasing the light distribution angle, adjusting the light distribution direction, or the like.

In this case, a sheet fixing groove 160*a* may be provided in the light-transmitting cover 160 so that the light distribution control sheet 170 can be detachably fixed thereto.

The light-transmitting cover 160 is coupled to the radiating member 130 by hooks.

Preferably, the light-transmitting cover 160 includes pressing protrusions 163 which press the power transfer substrate 110 to the top surface of the radiating member 130 in a state where the light-transmitting cover 160 has been coupled to the radiating member 130.

The pressing protrusions 163 can improve heat transfer between the power transfer substrate 110 and the radiating member 130 by increasing the close attachment of the power transfer substrate 110 and the radiating member 130.

Figure 6:
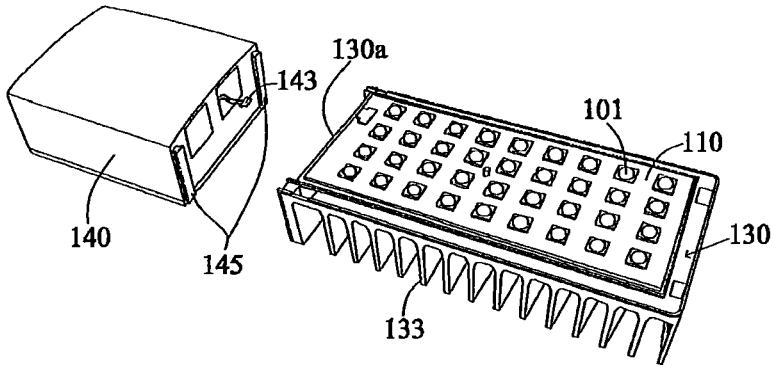
FIG. 6 is a view of coupling surfaces of the driver and the radiating member of FIG. 2.

FIG. 6 is a view of the coupling surfaces of the driver and the radiating member of FIG. 2. Coupling protrusions 145 are provided on the coupling surface of the driver 140 to be elongated in the vertical direction.

In addition, coupling grooves 135 are provided in the coupling surface of the radiating member 130 to be coupled to the coupling protrusions 145.

The coupling protrusions 145 and the coupling grooves 135 are coupled to each other in a sliding manner.

As such, the coupling protrusions 145 and the coupling grooves 135 can be coupled without elastic deformation, which prevents problems such as that the coupling force is reduced due to repeated elastic deformation or that damages occur due to the deformation force.

Figure 7:
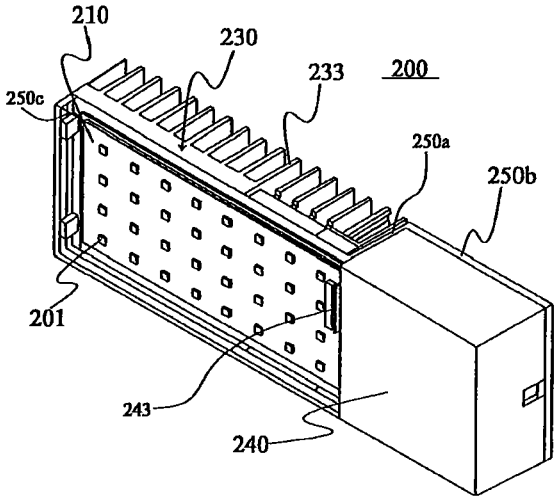
FIG. 7 is a view of a lighting apparatus using an LED according to another embodiment of the present disclosure.
Figure 8:
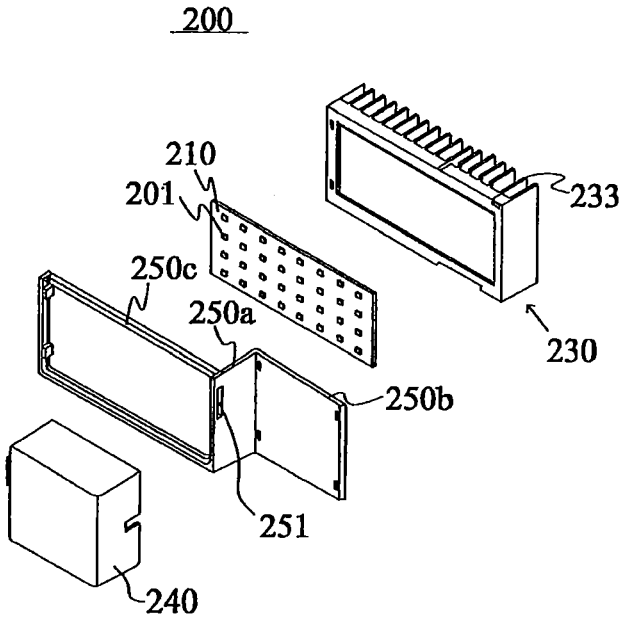
FIG. 8 is an exploded view of respective components of FIG. 7.

FIG. 7 is a view of a lighting apparatus using an LED according to another embodiment of the present disclosure, and FIG. 8 is an exploded view of respective components of FIG. 7. This configuration is almost the same as the configuration shown in FIGS. 2 to 6 except that the heat insulation layer 150 is provided not as the gap 150*a* but as a heat insulation plate 250*a*.

The heat insulation plate 250*a* is positioned between a side surface of a radiating member 230 and a side surface of a driver 240.

The heat insulation plate 250*a* acts as a heat resistance as much as its thickness during the heat transfer from the radiating member 230 to the driver 240.

The radiating member 230 and the driver 240 can be fixed to one surface and the other surface of the heat insulation plate 250*a*, respectively, and thus integrally coupled to each other.

For the coupling, protrusions and grooves may be coupled in a sliding manner such as in the above-described embodiment.

Alternatively, two plates 250*b* and 250*c* may be further provided so that the radiating member 230 and the driver 240 can be fixed thereto, respectively.

The two plates 250*b* and 250*c* are provided at both ends of the heat insulation plate 250*a*, respectively, provided in a direction orthogonal to the heat insulation plate 250*a*, and provided in a direction opposite to each other.

The two plates 250*b* and 250*c* may be coupled to or integrally formed with the heat insulation plate 250*a*.

In the two plates 250*b* and 250*c*, the plate 250*c* to which the radiating member 230 is fixed is positioned on a front surface of a power transfer substrate 210, i.e., at the front of an LED-installed surface, and the plate 250*b* to which the driver 240 is coupled is positioned on a rear surface of the driver 240.

As such, while the radiating member 230 and the driver 240 are firmly integrally fixed to each other, the driver 240 can be prevented from being damaged by heat radiated from the radiating member 230.

Here, it is preferable that the plate 250*c* should have a sufficient size to cover LEDs 201 provided on the power transfer substrate 210 and should be provided as a light-transmitting member transmitting light emitted from the LEDs 201.

Alternatively, the plate 250*c* may be a hollow ring in shape and the light-transmitting member may be coupled to the hollow portion.

Here, it can be appreciated that a scattering surface may be formed on the light-transmitting member or a light distribution control sheet 170 may be provided on the light-transmitting member, such as in the above-described embodiment.

Moreover, an opening 251 may be defined in the heat insulation plate 250*a* to make an electrical connection between the power transfer substrate 210 and the driver 240.

Figure 9:
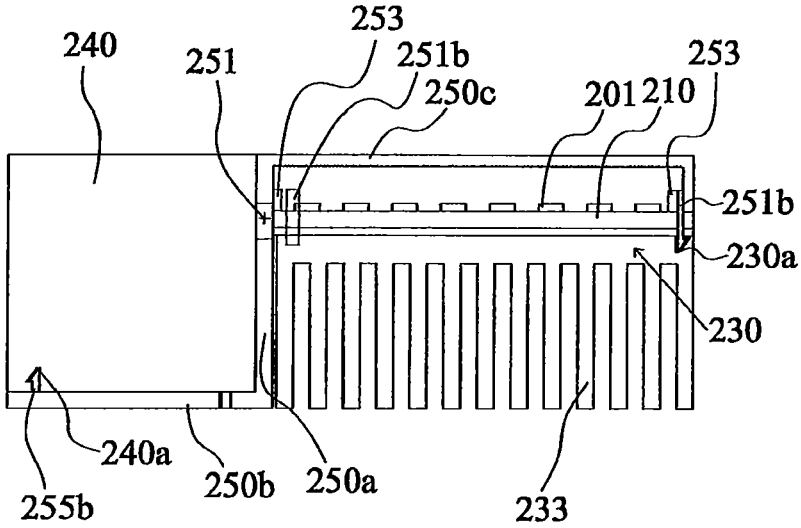
FIG. 9 is an assembled view of the respective components of FIG. 7.

FIG. 9 is an assembled view of the respective components of FIG. 7. Since the respective components of the lighting apparatus 200 using the LED according to the present embodiment are coupled not by separate coupling members such as screws but by hooks, the number of coupling process steps and the manufacturing costs can be cut down.

In detail, so as to couple the plate 250*c* and the radiating member 230, hooks 251*b* and hook grooves 230*a* are formed on the surfaces of the plate 250*c* and the radiating member 230 which are opposite to each other upon the coupling.

Likewise, in order to couple the plate 250*b* and the driver 240, hooks 255*b* and hook grooves 240*a* are formed on the surfaces of the plate 250*b* and the driver 240 which are opposite to each other upon the coupling.

As such, the elements for coupling the two components are not exposed to the outside, thus advantageously maintaining the good external appearance.

Figure 10:
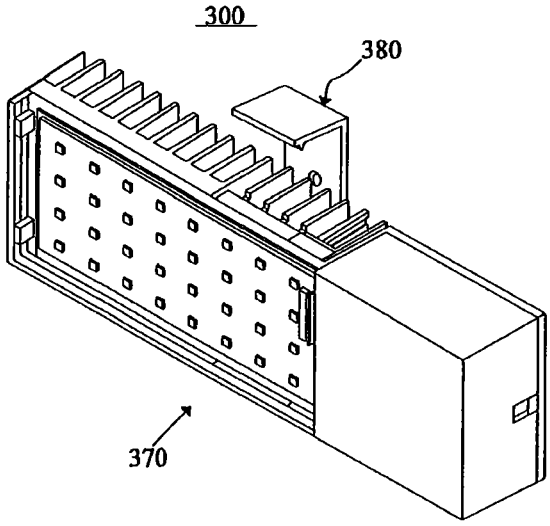
FIG. 10 is a view of a lighting apparatus using an LED according to a further embodiment of the present disclosure.
Figure 11:
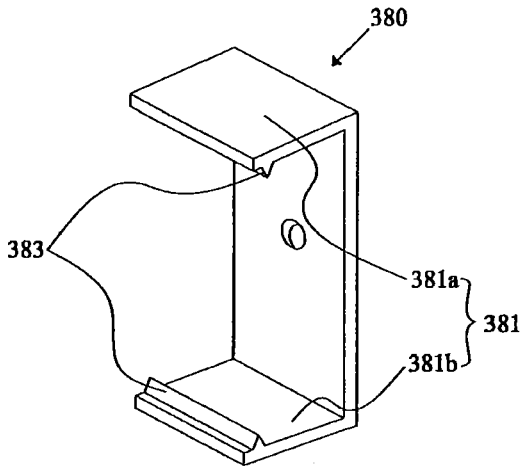
FIG. 11 is a view of a cradle of FIG. 10.

FIG. 10 is a view of a lighting apparatus using an LED according to a further embodiment of the present disclosure, and FIG. 11 is a view of a cradle of FIG. 10. A lighting apparatus 300 using an LED according to the present embodiment includes a lighting body 370 and a cradle 380.

The lighting body 370 is provided as the lighting apparatus 100 or 200 using the LED as shown in FIGS. 2 and 7.

The cradle 380 is a structure for fixing the lighting body 370 to a given object (e.g., the wall, the ceiling, or the inside of a conventional lamp apparatus).

The cradle 380 and the given object may be coupled by screws, hooks, and so on, and it is preferable that the cradle 380 should have a surface corresponding to the surface curvature of the given object to be firmly fixed to the given object. The cradle 380 includes a pair of brackets 381*a* and 381*b* for detachably fixing the lighting body 370.

The pair of brackets 381*a* and 381*b* are provided opposite to each other, and either or both of the pair of brackets 381*a* and 381*b* are made of ad elastically-deformable material.

As such, when the lighting body 370 is fitted between the pair of brackets 381*a* and 381*b*, it is fixed by the restoring force produced by elastic deformation.

Here, in order to more firmly fix the lighting body 370, it is preferable that at least one of the pair of brackets 381*a* and 381*b* should be coupled to the lighting body 370 by hooks.

Figure 12:
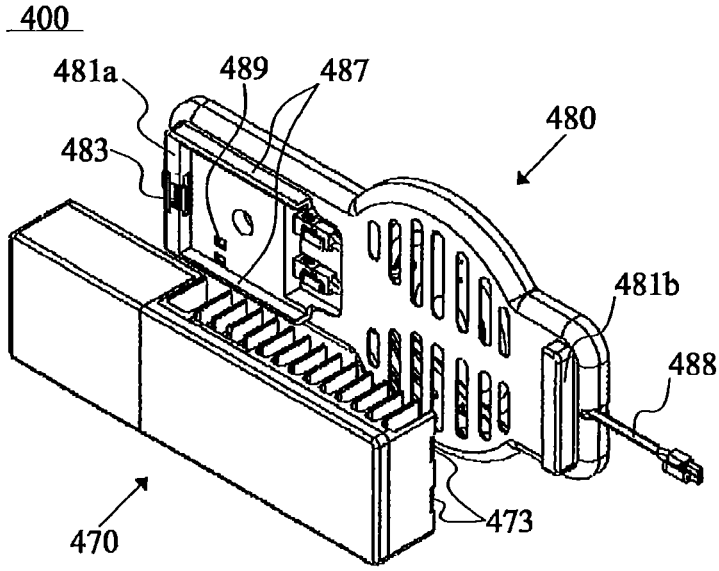
FIG. 12 is a view of a lighting apparatus using an LED according to a still further embodiment of the present disclosure.
Figure 13:
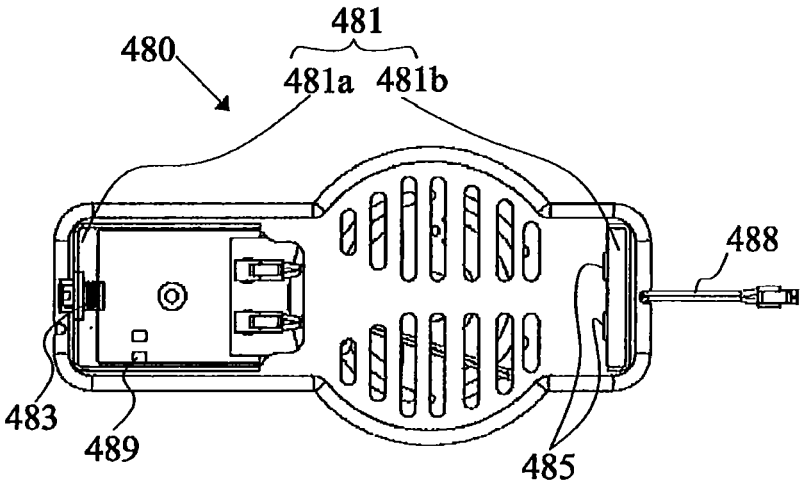
FIG. 13 is a view of a cradle of FIG. 12.
Figure 14:
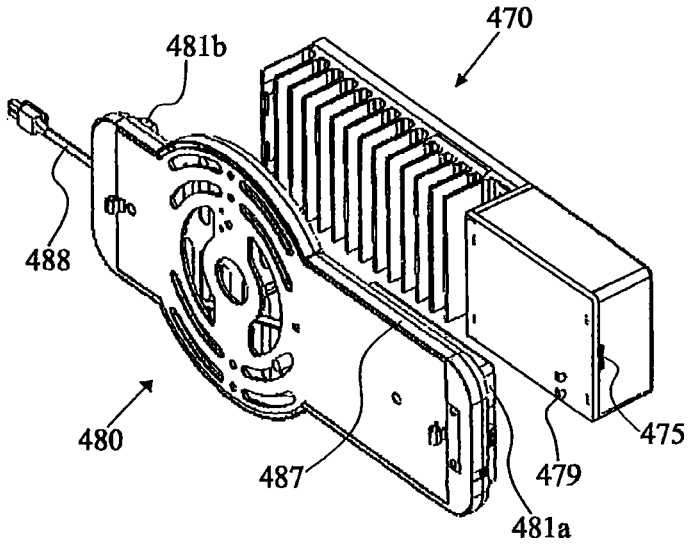
FIG. 14 is a view of the lighting apparatus using the LED of FIG. 12, when viewed in a different direction.
Figure 15:
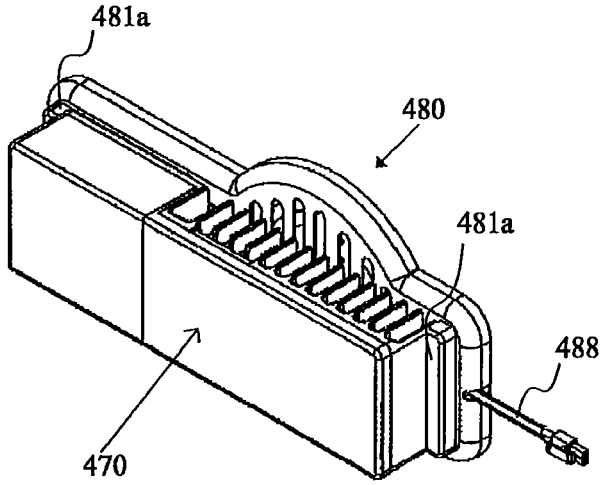
FIG. 15 is a view of a coupling state of a lighting body and the cradle of the lighting apparatus using the LED of FIG. 12.

FIG. 12 is a view of a lighting apparatus using an LED according to a still further embodiment of the present disclosure, FIG. 13 is a view of a cradle of FIG. 12, FIG. 14 is a view of the lighting apparatus using the LED of FIG. 12, when viewed in a different direction, and FIG. 15 is a view of a coupling state of a lighting body and the cradle of the lighting apparatus using the LED of FIG. 12. A cradle 480 includes a pair of brackets 481*a* and 481*b* supporting both side surfaces of a lighting body 470, respectively, and an elastic protrusion 483 fixing the lighting body 470.

The elastic protrusion 483 is elastically supported by the bracket 481*a* so that the restoring force can act in a direction of decreasing an interval between the pair of brackets 481*a* and 481*b*.

As such, when an external force is not applied to the elastic protrusion 483, the elastic protrusion 483 protrudes from one bracket 481*a* to the other bracket 481*b*.

On the contrary, when the lighting body 470 is fitted between the pair of brackets 481*a* and 481*b*, the elastic protrusion 483 is pressed by the lighting body 470. As a result, the elastic protrusion 483 applies the restoring force to a side surface of the lighting body 470, thereby fixing the lighting body 470.

Separation of the lighting body 470 is achieved by applying the force to the elastic protrusion 483 in a direction of increasing the interval between the pair of brackets 481*a* and 481*b*.

Meanwhile, so as to firmly fix the lighting body 470 using the elastic protrusion 483, a fixing groove 475 may be provided in the lighting body 470 so that the elastic protrusion 483 can be fitted thereinto.

In addition, in order to more firmly fix the lighting body 470, it is preferable that fixing protrusions 485 should be further provided on the bracket 481*b* which does not have the elastic protrusion 483 and that fixing grooves 473 to which the fixing protrusions 485 are to be coupled should be further provided in the side surface of the lighting body 470 supported by the bracket 481*b*.

Here, the coupling of the fixing protrusion 485 and the fixing groove 473 can prevent the movement of the lighting body 470.

In the meantime, preferably, the cradle 480 further includes short guide projections 487 brought into contact with the side surfaces of the lighting body 470 and constantly maintaining the position of the lighting body 470, when the lighting body 470 is fixed between the pair of brackets 481*a* and 481*b*.

The short guide projections 487 are elements for constantly maintaining the position of the lighting body 470 with respect to the cradle 480 when the lighting body 470 is fixed to the cradle 480.

Meanwhile, according to the present embodiment, it is preferable that a lighting-side power source terminal 479 and a cradle-side power source terminal 489, which are connected to each other when the lighting body 470 is fixed to the cradle 480, should be provided on the lighting body 470 and the cradle 480.

The lighting-side power source terminal 479 is provided on the lighting body 470, connected to LEDs via a driver and a power transfer substrate, and exposed to the outside of the lighting body 470.

Preferably, the lighting-side power source terminal 479 is provided on a rear surface of the driver to which power is input first.

The cradle-side power source terminal 489 is provided on the cradle 480 and positioned to be connected to the lighting-side power source terminal 479 when the lighting body 470 is fixed to the cradle 480.

Moreover, the cradle-side power source terminal 489 is connected to an external power source (not shown) by a power cable 488, and it is preferable that the power cable 488 should be exposed to the outside via the inside of the cradle 480 so as not to impair the external appearance of the cradle 480.

As such, since the power cable is removed from the lighting body 470, the manufacturing costs can be cut down and the external appearance of the lighting body 470 can be improved.

In addition, since the lighting-side power source terminal 479 is positioned on the rear surface of the lighting body 470, when the lighting body 470 is fixed to the cradle 480, contaminants are less introduced into the lighting-side power source terminal 479 and the cradle-side power source terminal 489.

Moreover, in order to prevent a contact failure of the lighting-side power source terminal 479 and the cradle-side power source terminal 489, it is preferable that at least one of the lighting-side power source terminal 479 and the cradle-side power source terminal 489 should be elastically supported so that the restoring force can act in a direction of bringing the lighting-side power source terminal 479 and the cradle-side power source terminal 489 into contact with each other.

Meanwhile, although the cradle 480 has been illustrated and described with reference to FIGS. 10 to 15 on the assumption that the lighting body 470 is the lighting apparatus 100 or 200 using the LED as shown in FIGS. 2 and 7, the lighting body 470 which can be fixed to the cradle 480 is not limited thereto but may be embodied as various types of lighting apparatuses.

Figure 16:
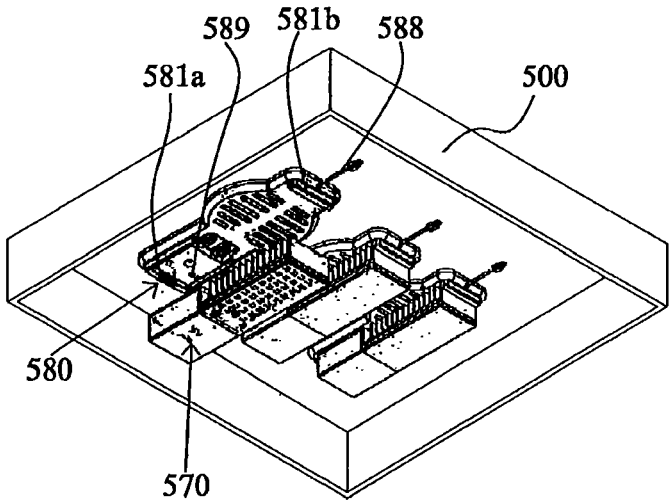
FIG. 16 is a view of a using state of the lighting apparatus using the LED according to the present disclosure.

FIG. 16 is a view of a using state of the lighting apparatus using the LED according to the present disclosure, wherein a lighting body 570 and a cradle 580 according to the present disclosure are installed in a case 500 of a lamp apparatus which is a general lighting apparatus.

First, the cradle 580 is fixed to the inside of the case 500.

This fixing may be achieved by using screws, or attaching a hook-shaped latch to the inside of the case 500, defining a hook groove in a rear surface of the cradle 580, and using a coupling force thereof.

Next, the lighting body 570 is fixed between brackets 581*a* and 581*b* provided on the cradle 580, and a power cable 588 connected to a cradle-side power source terminal 589 is connected to an external power source (not shown), thereby finishing the installation of the lighting body 570 and the cradle 580.

Hereinafter, various modes of the present disclosure will be described.

(1) A lighting apparatus using an LED, in which a heat insulation layer is provided as a gap defined between the radiating member and the driver.

(2) A lighting apparatus using an LED, in which a radiating member comprises a plurality of radiating fins, and an interval between the pair of radiating fins positioned on one side of the radiating member to which the driver is coupled is the largest among intervals between the pairs of radiating fins adjacent to each other.

(3) A lighting apparatus using an LED, in which a light-emitting diode positioned most adjacent to the driver among the light-emitting diodes provided on the power transfer substrate is positioned apart from the driver by a preset spacing distance.

(4) A lighting apparatus using an LED, in which a radiating member and the driver are coupled to each other by a coupling protrusion provided on any one of the radiating member and the driver and a coupling groove provided in the other one.

(5) A lighting apparatus using an LED, in which a coupling protrusion and the coupling groove are elongated along coupling surfaces of the radiating member and the driver.

(6) A lighting apparatus using an LED, in which a light-transmitting cover covers the LEDs and allows light emitted from the LEDs to transmit therethrough.

(7) A lighting apparatus using an LED, in which a light-transmitting cover is coupled to the radiating member by a hook and comprises a pressing protrusion pressing the power transfer substrate to the radiating member upon the hook coupling.

(8) A lighting apparatus using an LED, in which a light distribution control sheet is provided on the light-transmitting cover, controls the light distribution characteristics, and comprises a sheet fixing groove for fixing the light distribution control sheet.

(9) A lighting apparatus using an LED, in which a heat insulation layer is provided as a heat insulation plate provided between the radiating member and the driver.

(10) A lighting apparatus using an LED, in which a first fixing plate is extended from one end of the heat insulation plate in a bent direction and having the radiating member fixed thereto, and a second fixing plate is extended from the other end of the heat insulation plate in a direction opposite to the first fixing plate and having the driver fixed thereto.

(11) A lighting apparatus using an LED, in which a first fixing plate is positioned on a front surface of a power transfer substrate and provided as a light-transmitting member.

(12) A lighting apparatus using an LED, in which a first fixing plate is coupled to a radiating member by a hook and further includes a pressing protrusion pressing a power transfer substrate to the radiating member upon the hook coupling.

(13) A lighting apparatus using an LED, in which a driver is fixed to the entire surface of a second fixing plate, and the second fixing plate and the driver are coupled to each other by a coupling protrusion provided on any one of them and a coupling groove provided in the other one.

(14) A lighting apparatus using an LED, in which a coupling protrusion and a coupling groove are elongated along coupling surfaces of a second fixing plate and a driver.

(15) A lighting apparatus using an LED, in which a cradle is fixed to a given object and detachably fixes a lighting body in which the power transfer substrate with the light-emitting diodes thereon, the radiating member and the driver have been integrally coupled.

(16) A lighting apparatus using an LED, in which a cradle comprises a pair of brackets pressing both side surfaces of the lighting body to fix the lighting body.

(17) A lighting apparatus using an LED, in which at least one of the pair of brackets is elastically supported to vary in position.

(18) A lighting apparatus using an LED, in which at least one of the pair of brackets comprises a fixing protrusion on its surface brought into contact with the lighting body, and the lighting body comprises a fixing groove to which the fixing protrusion is coupled.

(19) A lighting apparatus using an LED, in which a cradle comprises a short guide projection constantly guiding a fixing position of the lighting body.

(20) A lighting apparatus using an LED, in which a short guide projection guides at least one side surface of the lighting body other than both side surfaces of the lighting body pressed by the pair of brackets.

(21) A lighting apparatus using an LED, in which a lighting body comprises a lighting-side power source terminal electrically connected to the light-emitting diodes via the driver, and the cradle comprises a cradle-side power source terminal connected to the lighting-side power source terminal when the cradle is coupled to the lighting body.

(22) A lighting apparatus using an LED, in which a lighting-side power source terminal and the cradle-side power source terminal are positioned on respective surfaces of the lighting body and the cradle which are opposite to each other upon the coupling of the lighting body and the cradle.

(23) A lighting apparatus using an LED, in which at least one of the lighting-side power source terminal and the cradle-side power source terminal is elastically supported in a direction of connecting both terminals.

According to a lighting apparatus using an LED of the present disclosure, while a power transfer substrate, a radiating member and a driver are integrally coupled, a heat insulation layer is provided between the radiating member and the driver, thereby preventing the driver from being damaged by heat radiated from the radiating member.

Therefore, the lighting apparatus using the LED can have an extended period of life, and the lighting apparatus using the LED in which the power transfer substrate, the radiating member and the driver have been integrally coupled can improve compatibility with conventional lamp apparatuses.

In addition, according to another lighting apparatus using an LED of the present disclosure, since a driver is exposed to the outside, it is easy to replace in the event of a failure, which cuts down unnecessary costs for replacing the entire lighting apparatus using the LED.

Moreover, according to a further lighting apparatus using an LED of the present disclosure, since components are coupled not by separate coupling members such as screws but by hooks, the number of coupling process steps and the manufacturing costs can be cut down. Further, the elements for coupling the components are not exposed to the outside, thus maintaining the good external appearance.

Furthermore, according to a still further lighting apparatus using an LED of the present disclosure, since a cradle is provided to simplify an installation procedure and freely control an installation position, the lighting apparatus using the LED can be easily applied to the inside of a case of a conventional lamp apparatus, and the number and installation position of the lighting apparatuses using the LED can be adjusted according to the size and characteristics of a place to be lighted.

What is claimed is:

1. A lighting apparatus using a light-emitting diode, the lighting apparatus comprising:

a power transfer substrate;

light-emitting diodes disposed on the power transfer substrate;

a radiating member coupled to the power transfer substrate, the radiating member radiating heat generated from the light-emitting diodes;

a driver electrically connected to the power transfer substrate and integrally coupled to the power transfer substrate and the radiating member; and a heat insulation layer disposed between the radiating member and the driver, the heat insulation layer reducing an amount of heat transferred from the radiating member to the driver.

2. The lighting apparatus of claim 1, wherein the heat insulation layer defines a gap between the radiating member and the driver.

3. The lighting apparatus of claim 1, wherein the radiating member comprises a plurality of spaced-apart radiating fins which are extending from one side of the radiating member, and arranged and spaced one another at one or more intervals, and an interval between a pair of radiating fins positioned most adjacent to the driver is larger than any other intervals among the one or more intervals.

4. The lighting apparatus of claim 1, wherein a light-emitting diode positioned most adjacent to the driver among the light-emitting diodes disposed on the power transfer substrate is positioned apart from the driver by a predetermined spacing distance.

5. The lighting apparatus of claim 1, wherein the radiating member is coupled to the driver in such a manner that a coupling protrusion provided on any one of the radiating member and the driver is engaged with a coupling groove provided in the other one.

6. The lighting apparatus of claim 5, wherein the coupling protrusion and the coupling groove are elongated along coupling surfaces of the radiating member and the driver.

7. The lighting apparatus of claim 1, further comprising a light-transmitting cover for covering the light-emitting diodes, the light-emitting cover allowing light emitted from the light-emitting diodes to transmit therethrough.

8. The lighting apparatus of claim 7, wherein the light-transmitting cover is coupled to the radiating member by a hook and comprises a pressing protrusion pressing the power transfer substrate to the radiating member upon the hook coupling.

9. The lighting apparatus of claim 7, further comprising a light distribution control sheet provided on the light-transmitting cover and controlling the light distribution characteristics, wherein the light-transmitting cover comprises a sheet fixing groove for fixing the light distribution control sheet.

10. The lighting apparatus of claim 1, wherein the heat insulation layer includes a heat insulation plate disposed between the radiating member and the driver.

11. The lighting apparatus of claim 10, further comprising:

a first fixing plate extended from one end of the heat insulation plate in a generally perpendicular relationship to provide a mount for the radiating member; and a second fixing plate extended from the other end of the heat insulation plate in a generally perpendicular relationship and in a direction opposite to the first fixing plate to provide a mount for the driver.

12. A lighting apparatus using a light-emitting diode, the lighting apparatus comprising:

a power transfer substrate;

a plurality of light-emitting diodes disposed in a spaced apart relationship on the power transfer substrate;

a radiating member coupled to the power transfer substrate, the radiating member radiating heat generated from the plurality of light-emitting diodes, the radiating member including a plurality of spaced-apart radiating fins that are positioned opposite to the plurality of light-emitting diodes and are extending from one side of the radiating member;

a driver electrically coupled to the power transfer substrate, the driver being engaged with one end of the power transfer substrate and of the radiating member; and a heat insulation means disposed between the radiating member and the driver, the heat insulation means being configured for reducing an amount of heat transferred from the radiating member to the driver.

* * * * *